US008734108B1

(12) United States Patent
Liang

(10) Patent No.: US 8,734,108 B1
(45) Date of Patent: May 27, 2014

(54) TURBINE BLADE WITH IMPINGEMENT COOLING CAVITIES AND PLATFORM COOLING CHANNELS CONNECTED IN SERIES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 447 days.

(21) Appl. No.: 13/301,831

(22) Filed: Nov. 22, 2011

(51) Int. Cl.
*F01D 5/18* (2006.01)

(52) U.S. Cl.
USPC ..... 416/97 R; 416/96 A

(58) Field of Classification Search
CPC ..... F01D 5/08; F01D 5/081; F01D 5/082; F01D 5/084; F01D 5/18; F01D 5/187; F01D 5/188; F01D 5/189; F01D 5/186
USPC .... 415/115, 116; 416/97 R, 97 A, 96 R, 96 A
See application file for complete search history.

(56) References Cited

U.S. PATENT DOCUMENTS

| | | | | |
|---|---|---|---|---|
| 5,634,766 | A * | 6/1997 | Cunha et al. | 415/115 |
| 5,954,475 | A * | 9/1999 | Matsuura et al. | 415/115 |
| 6,132,173 | A * | 10/2000 | Tomita et al. | 416/96 R |
| 7,008,178 | B2 * | 3/2006 | Busch et al. | 415/115 |
| 7,147,439 | B2 * | 12/2006 | Jacala et al. | 416/97 R |
| 8,011,881 | B1 * | 9/2011 | Liang | 415/115 |
| 2002/0090294 | A1 * | 7/2002 | Keith et al. | 415/115 |
| 2010/0143154 | A1 * | 6/2010 | Abba et al. | 416/97 R |
| 2010/0239432 | A1 * | 9/2010 | Liang | 416/97 R |

* cited by examiner

*Primary Examiner* — Edward Look
*Assistant Examiner* — William Grigos
(74) *Attorney, Agent, or Firm* — John Ryznic

(57) ABSTRACT

A turbine rotor blade with impingement cooling cavities for the airfoil and serpentine flow cooling channels for the platform of the blade. Two impingement cavities provide cooling for the forward section of the airfoil while another two impingement cavities provide cooling for the aft section of the airfoil. Both impingement cavity cooling circuits are connected in series to platform cooling channels that use the same cooling air to cool the platform. The spent cooling air from the platform cooling channels is discharged into a dead rim cavity as purge air for the blade. The blade with the impingement cavities and the platform serpentine flow cooling channels are all formed as a single piece from a metal printing process.

13 Claims, 5 Drawing Sheets

TURBINE BLADE WITH IMPINGEMENT COOLING CAVITIES AND PLATFORM COOLING CHANNELS CONNECTED IN SERIES

Turbine blade with impingement cooling cavities and platform cooling channels connected in series.

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to a single piece turbine rotor blade having impingement cooling for the airfoil and convection cooling for the platform.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Turbine blades are cooled using a combination of convection cooling, impingement cooling and film cooling in order to control the blade metal temperature in order to prevent thermal damage such as erosion and to provide for a long blade life. The internal cooling air passages and features are formed using an investment casting process in which a ceramic core is used to form the internal cooling air passages within a metal blade. The ceramic core is placed within a mold and liquid metal is poured over the ceramic core and solidified to form the blade. The ceramic core is then leached away from the solidified blade to leave the internal cooling air passages within the blade. Film cooling holes are then drilled into the blade using a laser or an EDM probe.

Use of the ceramic core in the investment casting process to form a blade has two major limitations. One is that the internal cooling air passages and features cannot be formed in complex shapes because of the way that the ceramic core is formed. The ceramic core is cast within a mold such that the features must be aligned with a pulling direction of the mold pieces. For example, ribs that extend from a pressure side wall to a suction side wall must be parallel to the pulling direction of the mold. Also, the ribs must not be angled or tapered that would prevent the mold piece from being pulled away from the hardened ceramic core. Second, features smaller than around 1.3 mm in diameter cannot be cast successfully because of the weakness of the ceramic material in the ceramic core. The relatively heavy liquid metal that flows around the ceramic core features would break off such small ceramic core pieces such as the pieces that form impingement cooling air holes. Broken pieces within the ceramic core due to the liquid metal flowing would result in defective cast blades.

BRIEF SUMMARY OF THE INVENTION

A turbine rotor blade has impingement cavities formed in the forward and aft sections of the airfoil to provide impingement cooling to the airfoil walls. The platform includes a number of serpentine flow cooling circuits to provide convection cooling to the platform hot surfaces. The impingement cavities and the airfoil walls and the platform serpentine cooling channels are all formed as a single piece from a metal printing process capable of forming cooling air channels and features too small or too complex for investment casting process using a ceramic core.

A forward half of the airfoil is cooled using a first impingement cavity connected in series with a second impingement cavity to cool the forward half of the airfoil along the walls and the blade tip. The cooling air from the forward impingement cavities is then used to cool the forward section of the platform. The aft half of the airfoil is cooled using a third impingement cavity connected in series with a fourth impingement cavity to cool the aft half of the airfoil along the walls and the blade tip. The cooling air from the aft impingement cavities is then used to cool the aft section of the platform. Cooling air from both platform cooling channels is discharged into a dead rim cavity as purge air for the blade.

The blade with the impingement cavities and the platform cooling channels are formed as a single piece using a metal printing process in which cooling holes and features can be formed too small for an investment casting process using a ceramic core. The blade can also be printed such that the hooter airfoil walls and the cooler impingement cavities can be made from different materials.

DETAILED DESCRIPTION OF THE INVENTION

The present invention is a turbine rotor blade that has a high taper and a high twist with impingement cooling air features that are too small and too complex in shape to be formed using the investment casting process with a ceramic core. A method developed by Mikro Systems, Inc. of Charlottesville, Va. that uses a laser sintering process or something like that can print metal parts with vary complex shapes and of such small size that cannot be done using investment casting. The metal printing process can print a single piece part with any size and shape desired. This metal printing process can form very small cooling air holes that cannot be cast. Also, this metal printing process can form features that cannot be cast due to the pulling direction of the mold pieces.

Figure 1:
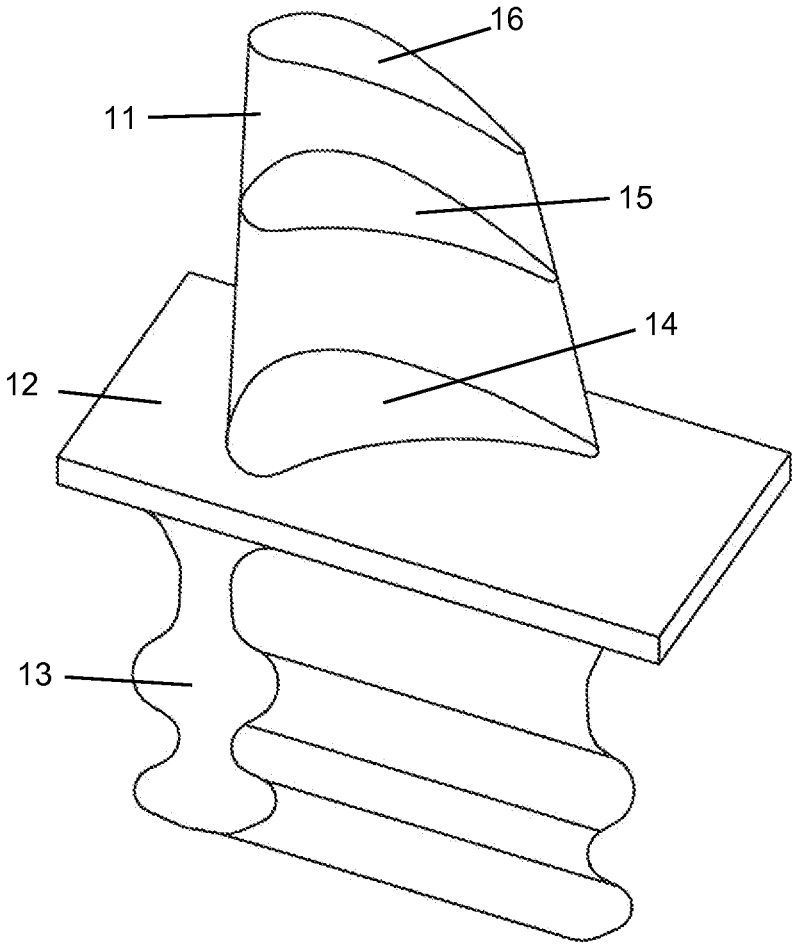
FIG. 1 shows an isometric view of a turbine rotor blade having the internal cooling passages and features of the present invention.

FIG. 1 shows a turbine rotor blade that has the internal cooling air features of the present invention. The blade includes an airfoil section 11 extending from a platform 12 and an attachment 13 such as a fir tree configuration. The airfoil section 11 includes a root section 14, a mid-span section 15 and a tip section 16. The airfoil is a highly twisted and tapered airfoil in the radial or spanwise direction of the blade. With this amount of twist and taper, the cooling passages of the present invention could not be formed from the investment casting process with a ceramic core.

Figure 2:
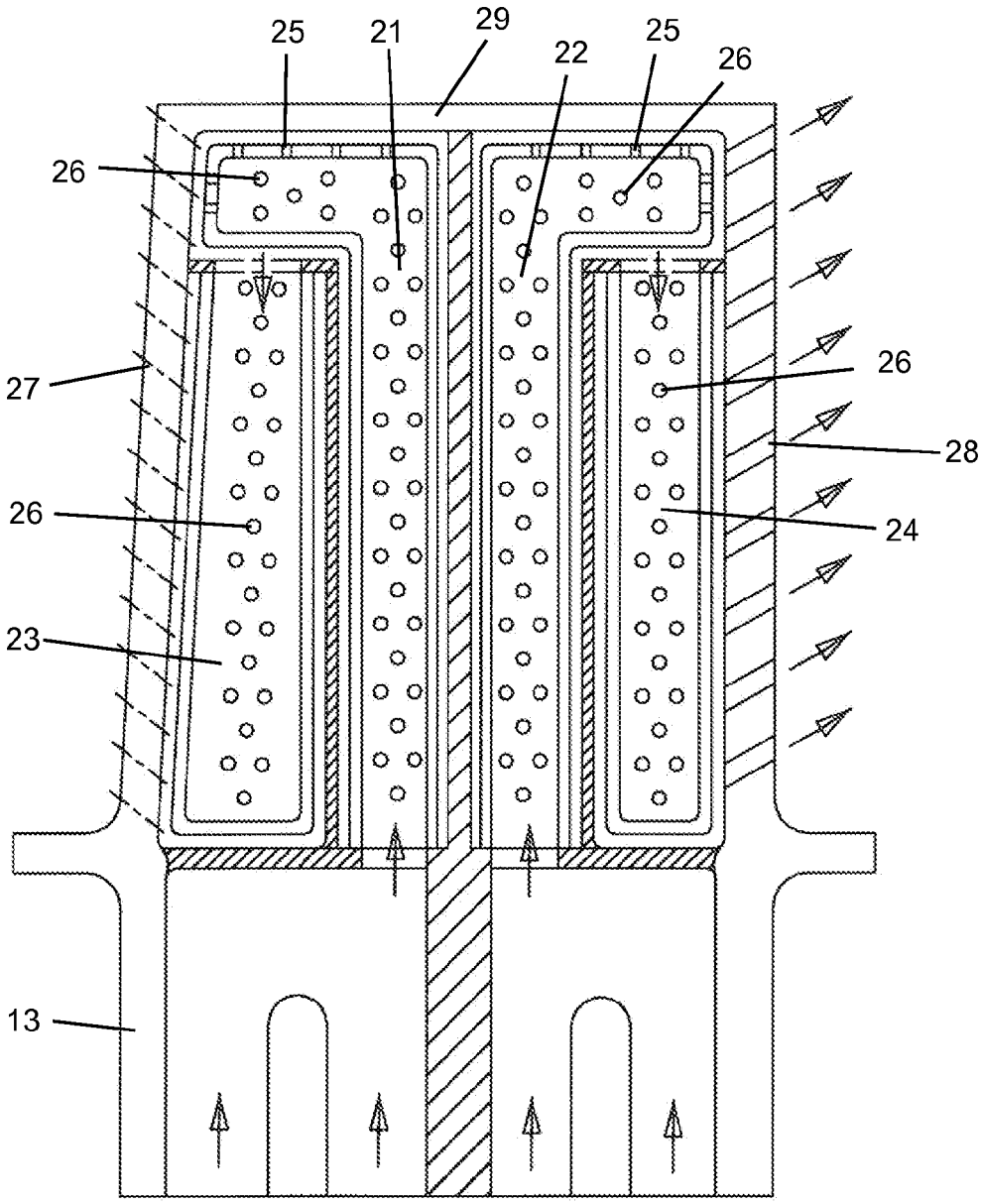
FIG. 2 shows a cross section side view of the internal cooling circuit of the blade of the present invention.
Figure 3:
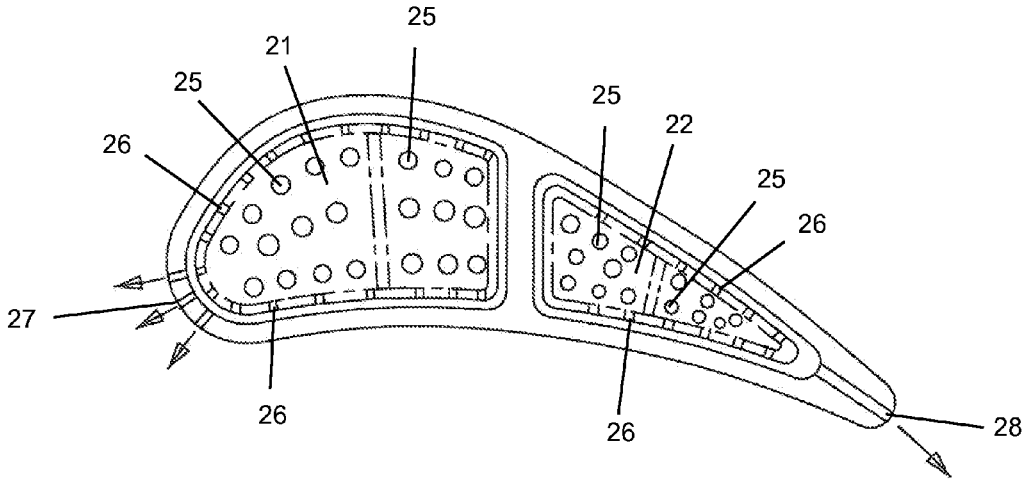
FIG. 3 shows a cross section top view of the blade cooling circuit of the present invention at the blade tip section.

FIG. 2 shows a side view of the internal cooling circuit of the blade of the present invention. The blade includes an internal cooling air circuit that includes a forward impingement cavity 21 and an aft impingement cavity 22 that both extend from a separate cooling air supply channel formed in the root 13 to just underneath a blade tip 29. At a blade tip end of both impingement cavities 21 and 22 cover the underside of the blade tip from a leading edge to a trailing edge of the blade tip as seen in FIG. 3. Both impingement cavities 21 and 22 include an arrangement of impingement cooling holes 26 to cool the backside walls of the airfoil and blade tip cooling holes 25 to cool the underside of the blade tip 29. A space is formed between the impingement cavities 21 and 22 and the inner walls of the airfoil as seen in FIG. 3 in which the impingement cooling air is collected and then channeled to a leading edge (LE) impingement cavity 23 and a trailing edge (TE) impingement cavity 24. Each of the four impingement cavities 21-24 can include a local stand-off that is used to position each impingement cavity at a specific distance from the inner surface of the airfoil wall so that the space will have a proper distance in which impingement cooling will be more effective. The stand-off does not connect both walls.

The leading edge and trailing edge impingement cavities 23 and 24 are formed under the enlarged sections of the forward and aft impingement cavities 21 and 22 and extend from them and down to the platform of the blade to provide impingement cooling for the leading edge and trailing edge regions of the airfoil. The LE and TE impingement cavities 23 and 24 also have an arrangement of impingement cooling air holes 26 that direct impingement cooling air against the inner walls of the airfoil in these regions of the airfoil. A space is also formed between the LE and TE impingement cavities 23 and 24 and the airfoil wall in which the spent impingement cooling air is collected and then redirected to cooling air channels formed within the platform of the blade.

FIG. 3 shows a cross section view of the blade through the upper or tip section 16 of FIG. 1. Both impingement cavities 21 and 22 include tip impingement cooling holes 25 and impingement cooling holes 26 for the airfoil walls. Showerhead arrangement of film cooling holes 27 are connected to the space in the leading edge region and exit holes are connected to the space in the trailing edge region.

Figure 4:
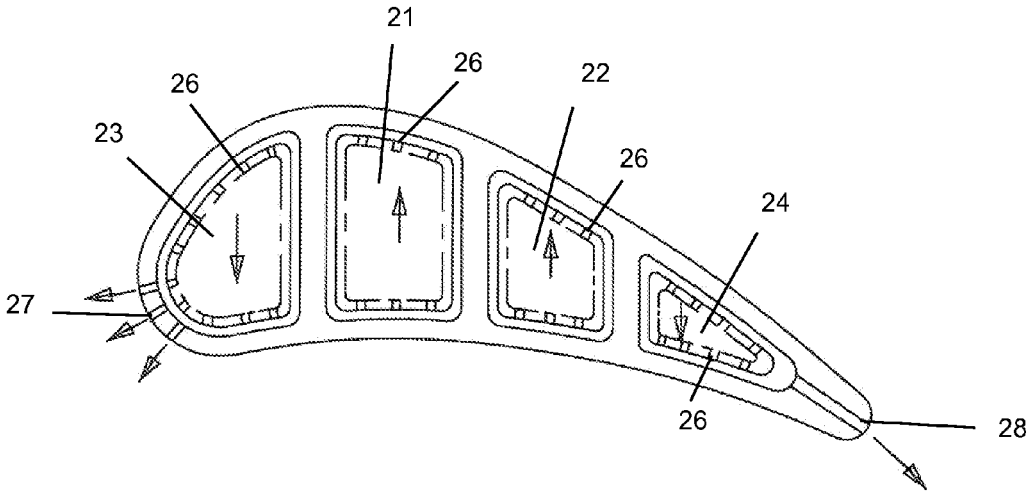
FIG. 4 shows a cross section top view of the blade cooling circuit of the present invention through a mid-span section.

FIG. 4 shows a cross section view of the blade through the mid-span section 15 of FIG. 1. The forward impingement cavity 21 and aft impingement cavity 22 are located in the mid-chord region of the airfoil between the leading edge region and the trailing edge region and include impingement cooling holes directed to discharge impingement cooling air to the inner walls of the airfoil. The LE impingement cavity 23 and the TE impingement cavity 24 also include impingement cooling holes 26 directed to discharge impingement cooling air to the inner walls of the airfoil. The leading edge region airfoil wall also includes a showerhead arrangement of film cooling holes 27 to discharge spent impingement cooling air. The trailing edge region of the airfoil includes a row of exit holes 28 connected to the space formed by the TE impingement cavity 24 to discharge spent impingement cooling air and cool the TE region of the airfoil.

Figure 5:
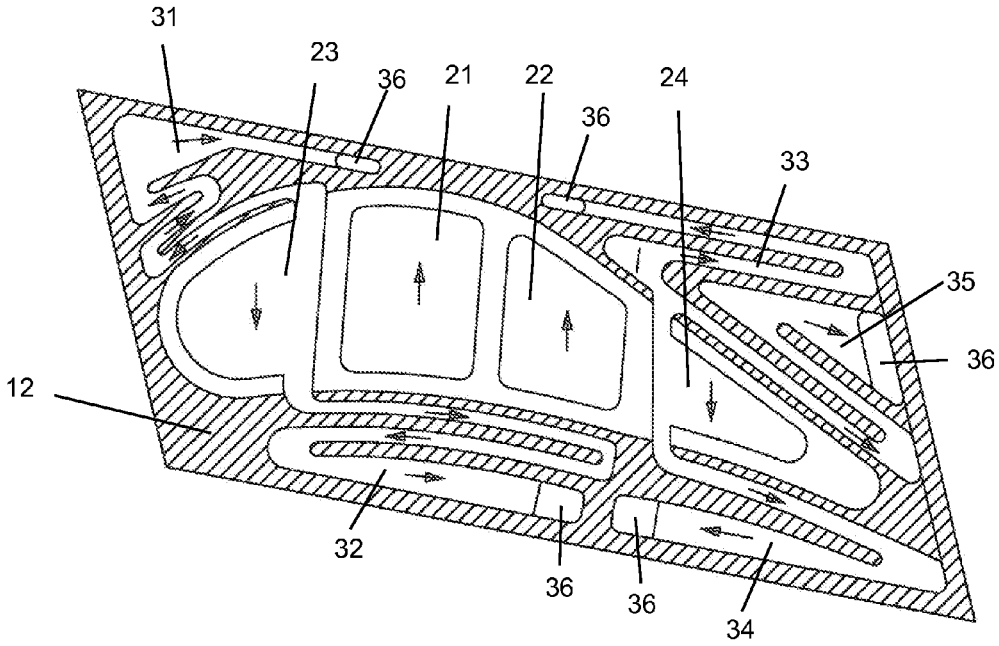
FIG. 5 shows a cross section top view of the blade cooling circuit of the present invention through a platform section.

FIG. 5 shows a cross section view of the blade through the platform section 14 of FIG. 1. The platform 12 includes a number of serpentine flow cooling channels formed within the platform to provide convection cooling using the cooling air discharged from the LE and TE impingement cavities 23 and 24. In this embodiment, the platform 12 includes five separate serpentine flow cooling channels 31-35 that cover the entire platform surface area exposed to the hot gas stream. Two forward platform serpentine flow cooling channels 31 and 32 are connected to the LE impingement cavity 23. Three aft platform serpentine flow cooling channels 33-35 are connected to the TE impingement cavity 24. Each serpentine flow cooling channel 31-35 is shaped to cover as much of the platform surface area as possible in order to provide effective platform cooling for the blade. Each of the serpentine flow cooling channels 31-35 is connected to an opening 36 at the end of the channel that will discharge the cooling air into a dead rim cavity located below the platform to function as purge air for the rim cavities.

The blade with the impingement cavities 21-24 and the airfoil walls and platform and root are all formed as a single piece using a metal printing process such as that developed by Mikro Systems, Inc. from Charlottesville, Va. which is like a laser sintering process that can print a metal or a ceramic part that is porous or with very small cooling air holes or passages that cannot be formed from an investment casting process that uses a ceramic core. Also, the Mikro Systems, Inc. process can print complex shaped features that cannot be cast using the investment casting process due to limitations such as the pulling direction on the ceramic core. Thus, the metal printing process can also be used to form a single piece turbine blade having a relatively high rate of twist and taper like the larger turbine blades used in an industrial gas turbine engine that cannot be produced with the investment casting process using the ceramic core. The metal printing process can also be used to produce a single piece turbine blade in which the impingement cavities can be formed from one material while the airfoil walls are formed from a different material. The hotter airfoil walls can be printed from a metal that has a higher temperature resistance than the cooler impingement cavities.

The impingement cavities 21-24 are also thermally uncoupled from the hotter airfoil walls due to the design of the present invention. Therefore, the hotter airfoil walls will not induce thermal stress within the impingement cavities that occur between the hotter airfoil walls and the cooler impingement cavities.

In operation, cooling air supplied to the root channels flows into the forward and aft impingement cavities 21 and 22 and then through the arrangement of impingement cooling air holes 26 and blade tip cooling holes 25 to provide impingement cooling for the airfoil walls located in this region of the airfoil. The cooling air is collected within the spaces formed between the impingement cavities 21 and 22 and the inner wall surfaces and redirected into the LE and TE impingement cavities 23 and 24. The cooling air in the LE and TE impingement cavities 23 and 24 then flows through the impingement cooling holes 26 to provide impingement cooling for the airfoil inner walls for the rest of the airfoil. The cooling air is then collected in the space formed between the airfoil walls and the impingement cavities 23 and 24 and redirected to the platform cooling channels 31-35. The cooling air from the LE impingement cavity 23 is directed to flow through the serpentine flow cooling channels 31 and 32 and then discharged out from the openings 36 and into the dead rim cavity located below the platform 12. The cooling air from the TE impingement cavity 24 is directed to flow through the serpentine flow cooling channels 33-35 and then discharged out from the openings 36 and into the dead rim cavity located below the platform 12. Some of the cooling air from the LE impingement cavity 23 flows through the film cooling holes 27 in the leading edge region of the airfoil. Some of the cooling air from the TE impingement cavity 24 flows through the exit cooling holes 28 in the trailing edge region of the airfoil. The remaining cooling air from the LE and TE impingement cavities 23 and 24 flows into the platform serpentine flow cooling channels 31-35 because no other film cooling holes are used on the pressure or suction side walls of the airfoil.

The single piece turbine rotor blade with the impingement cooling cavities and the platform serpentine flow cooling channels will provide for multiple impingements cooling of the airfoil walls and platform cooling and then purge air for the dead rim cavity. This design will maximize the usage of the cooling air for a given airfoil inlet gas temperature and pressure profile. also, use of the cooling air in a series of impingement cooling cavities will generate extremely high turbulence levels for a fixed amount of coolant flow that will yield a high value of internal heat transfer coefficient for the blade than would the prior art cooling circuits. As a result of this, a higher effective internal convection cooling is achieved than in the prior art turbine blades.

I claim the following:

1. A turbine rotor blade comprising:

an airfoil with a leading edge region and a trailing edge region and a pressure side wall and a suction side wall;

a platform and a root;

a forward impingement cavity and an aft impingement cavity both extending in a radial direction of the airfoil from the platform to underneath a blade tip;

a leading edge impingement cavity and a trailing edge impingement cavity;

the four impingement cavities each having an arrangement of impingement cooling air holes to provide impingement cooling for an inner wall of the airfoil;

the platform having a forward serpentine flow cooling circuit and an aft serpentine flow cooling circuit that provides convection cooling for a hot surface of the platform;

the forward impingement cavity and the leading edge impingement cavity and the forward serpentine flow cooling circuit being connected in series and form a first series of cooling air channels; and, the aft impingement cavity and the trailing edge impingement cavity and the aft serpentine flow cooling circuit being connected in series and form a second series of cooling air channels.

2. The turbine rotor blade of claim 1, and further comprising:

the four impingement cavities and the airfoil walls and the platform serpentine flow cooling circuits are all formed as a single piece blade.

3. The turbine rotor blade of claim 1, and further comprising:

the impingement cavities are formed from a different material with a lower temperature resistance than the walls of the airfoil.

4. The turbine rotor blade of claim 1, and further comprising:

the forward and aft impingement cavities both include blade tip cooling holes on a top end of the cavities that provide cooling of the blade tip.

5. The turbine rotor blade of claim 1, and further comprising:

the first series of cooling air channels is separate from the second series of cooling air channels such that the cooling air from one series does not mix with the other series.

6. The turbine rotor blade of claim 1, and further comprising:

the four impingement cavities are each thermally isolated from the airfoil walls.

7. The turbine rotor blade of claim 1, and further comprising:

the forward and aft serpentine flow cooling circuits both have a discharge opening connected to a dead rim cavity located below the blade platform.

8. The turbine rotor blade of claim 1, and further comprising:

the leading edge impingement cavity is connected to a showerhead arrangement of film cooling holes;

the trailing edge impingement cavity is connected to a row of trailing edge exit holes; and, the pressure side wall and the suction side wall are both without any film cooling holes connected to the impingement cavities.

9. The turbine rotor blade of claim 1, and further comprising:

the forward and aft impingement cavities both include an upper end that covers an entire underside of the blade tip; and, the upper ends include blade tip cooling holes to direct impingement cooling air to an underside surface of the blade tip.

10. A process for cooling a turbine rotor blade, the turbine rotor blade having an airfoil with a leading edge region and a trailing edge region and a pressure side wall and a suction side wall and a blade tip, and the blade having a platform, the process comprising the steps of:

passing a first cooling air flow into a first impingement cavity to provide impingement cooling to the pressure and suction side walls in a forward section of the airfoil;

passing the cooling air from the first impingement cavity through a second impingement cavity to provide impingement cooling to the leading edge region of the airfoil;

passing the cooling air from the second impingement cavity through a forward section of the platform to provide convection cooling to this section of the platform;

passing a second and separate cooling air flow into a third impingement cavity to provide impingement cooling to the pressure and suction side walls in an aft section of the airfoil;

passing the cooling air from the third impingement cavity through a fourth impingement cavity to provide impingement cooling to the trailing edge region of the airfoil;

passing the cooling air from the fourth impingement cavity through an aft section of the platform to provide convection cooling to this section of the platform; and, discharging the first and second cooling air flows from the platforms into a dead rim cavity to purge the dead rim cavity of hot gas.

11. The process of cooling the turbine rotor blade of claim 10, and further comprising the step of:

passing cooling air from the forward and aft impingement cavities through tip cooling holes to provide cooling for the blade tip.

12. The process of cooling the turbine rotor blade of claim 10, and further comprising the step of:

discharging some of the cooling air from the third impingement cavity as film cooling air onto the leading edge region surface of the airfoil.

13. The process of cooling the turbine rotor blade of claim 10, and further comprising the step of:

discharging some of the cooling air from the fourth impingement cavity through the trailing edge region to provide cooling to the trailing edge region of the airfoil.

* * * * *